United States Patent [19]

Takebayashi et al.

[11] Patent Number: 4,544,338

[45] Date of Patent: Oct. 1, 1985

[54] OIL FEEDER MEANS FOR USE IN A HORIZONTAL TYPE ROTARY COMPRESSOR

[75] Inventors: Masahiro Takebayashi; Akio Sakazume, both of Yokohama; Hiroshi Iwata, Odawara; Masahiko Sugiyama, Tochigi; Mitsuru Murata, Tochigi; Shigetaro Tagawa, Tochigi, all of Japan

[73] Assignee: Hitachi, Ltd., Tokyo, Japan

[21] Appl. No.: 610,440

[22] Filed: May 15, 1984

[30] Foreign Application Priority Data

May 27, 1983 [JP] Japan ..... 58-92286

[51] Int. Cl.[4] ..... F04C 18/00; F04C 29/02; F04B 39/02

[52] U.S. Cl. ..... 418/63; 418/87; 418/88; 417/368; 417/902; 417/557; 184/6.16

[58] Field of Search ..... 417/204, 368, 372, 410, 417/490, 542, 902, 557; 418/63, 87, 88; 184/6.16

[56] References Cited

U.S. PATENT DOCUMENTS

| | | | |
|---|---|---|---|
| 252,946 | 1/1882 | Gage | 417/542 X |
| 2,709,891 | 6/1955 | Dunbar et al. | 60/249 |
| 2,883,101 | 4/1959 | Kosfeld | 417/372 |
| 3,135,460 | 6/1964 | Galin | 418/88 |
| 3,565,552 | 2/1971 | Tuneo Mondem et al. | 417/372 |
| 3,897,173 | 7/1975 | Mandroian | 417/240 X |
| 4,385,875 | 5/1983 | Kanazawa | 418/88 X |

FOREIGN PATENT DOCUMENTS

| | | | |
|---|---|---|---|
| 511046 | 10/1930 | Fed. Rep. of Germany | 418/88 |
| 20795 | 2/1981 | Japan | 417/490 |
| 20796 | 2/1981 | Japan | 418/88 |
| 303953 | 1/1929 | United Kingdom | 417/490 |

*Primary Examiner*—William L. Freeh
*Assistant Examiner*—Paul F. Neils
*Attorney, Agent, or Firm*—Antonelli, Terry & Wands

[57] ABSTRACT

A horizontal type rotary compressor including a compression element having a cylinder, a shaft having a crank thereon, a pair of side plates concurrently serving both as bearings of the shaft and as side walls of the cylinder, a roller fitted onto the crank, and a vane so arranged as to slide in a groove of the cylinder and have a tip end thereof contacted with the roller rotating in accordance with the rotation of the crank and an appropriate end thereof urged by a spring to make a reciprocating movement along the groove are provided within a case. A pumping chamber is defined by a rear face of the vane, the groove of the cylinder and the side plates. One of the side plates is formed with a suction port capable of sucking thereinto the oil within the case while the other of the side plate is formed with a discharge port for transmitting the oil in the pumping chamber to an oil feeding passage. An oil feeder means for use in the horizontal type rotary compressor is a space provided at the exit of the suction port of the side plate having the suction port and the suction port opens downwardly so that the feeding of a sufficient or stable amount of oil is ensured even when the surface level of the oil is lowered.

5 Claims, 8 Drawing Figures

OIL FEEDER MEANS FOR USE IN A HORIZONTAL TYPE ROTARY COMPRESSOR

BACKGROUND OF THE INVENTION

The present invention relates to a horizontal type compressor incorporated into a refrigerating apparatus such as, for example, a refrigerator, air-conditioner, or the like and, more particularly, to a lubricating oil feeder means for such compressor.

One object of the present invention resides in providing an oil feeder means which ensures a supplying of a sufficient amount of oil even when a surface level of the oil in the case is lowered.

According to the present invention, an oil feeder means is provided wherein the entrance of a suction port used to introduce the oil in a case into a pumping chamber opens downwardly thereby ensuring a feeding of a sufficient or stable amount of oil even when the surface level of the oil is lowered.

DETAILED DESCRIPTION

Figure 1:
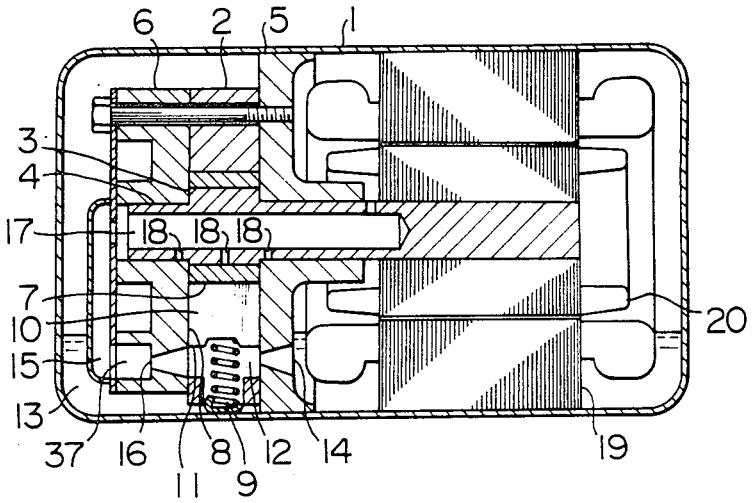
FIG. 1 is a sectional view of a rotary compressor to which an oil feeder means according to the present invention is applied.

Referring now to the drawings wherein like reference numerals are used throughout the various views to designate like parts and, more particularly, to FIG. 1, according to this figure, an oil feeder means for use in a horizontal type compressor of the type described in, for example, commonly assigned U.S. application Ser. No. 576,337 includes a compression element comprising a cylinder 2, a shaft 4 having a crank 3 theron, side plates 5 and 6 concurrently serving both as bearings of the shaft 4 and as side walls of the cylinder 2 and attached to the cylinder 2, a roller 7 fitted onto the crank 3, and a vane 10 sliding in a cylinder groove 8 an having its tip end contacted with the roller 7 rotating in accordance with the rotation of the crank 3 and its other end pushed by a spring 9 to make its reciprocating movement in the cylinder groove. A pumping chamber 12 is defined by a rear face 11 of the vane 10, cylinder groove 8, side plates 5 and 6, with the side plate 5 being formed with a suction port 14 capable of permitting an oil 13 within the case 1 to be sucked into the pumping chamber 12. The side plate 6 is formed with a discharge port 16 capable of discharging the oil from the pumping chamber 12 into an oil transmitting passage 15, and the oil transmitting passage 15 supplied supply the oil into an axial bore 17 of the shaft 4 and then supplies or feeds it into a portion to be lubricated from the axial bore 17 through its branching apertures 18.

It is to be noted that a rotor 20 attached to the end of the shaft 4, imparts a rotational force to the shaft 4 through a stator 19 and thereby rotate the shaft 4.

Figure 2:
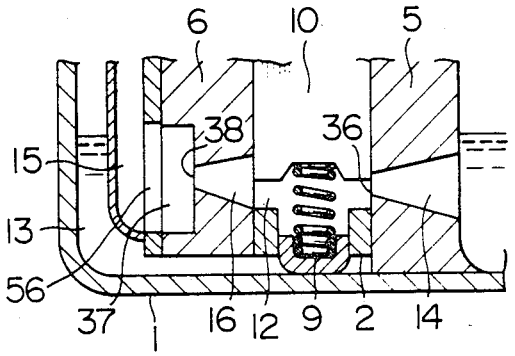
FIG. 2 is a sectional view of the part of the oil feeder means of FIG. 1.

As shown in FIG. 2 the suction part 14 is a tapered port which having a small diameter at its portion opening into the side of the pumping chamber 12 and a large in diameter at a portion opening into the oil 13 within the case 1. On the other hand, the discharge port 16 is a tapered port having a truncated cone shape with a large diameter at its portion opening into the side of the pumping chamber 12 and a small diameter at a portion opening into the side of the oil transmitting passage 15 and a space 37 is provided between said small diameter portion and the cylindrical passage 56 communicated with the oil transmitting passage 15. Accordingly, in any case of the suction port 14 and discharge port 16, when the oil flows forwards from the large-diameter portion toward the small diameter portion, the oil flow is smooth. On the contrary, when the oil flows backwards from the pumping chamber 12 toward the large-diameter portion through an end face 36 of the small-diameter port portion, the reverse oil flow becomes non-smooth due to an increase in the flow resistance caused by an edge effect of the end face 36 of the small-diameter port portion. Similarly, when the oil flows backwards from the space 37 toward the large-diameter portion through an end face 38 of the small-diameter port portion, the resistance to flow of the oil is also high. With the above-mentioned construction, putting the compressor into operation results in the shaft and the roller 7 being rotated. Thus, the vane 10 is pushed by the spring 9 and, while its tip end is kept in contact with the roller 7, is reciprocatingly moved in the groove 8 of the cylinder 2. When the vane 10 makes its reciprocating movement in such way, the pumping chamber 12 has its volume varied and thus pumping operation is performed. That is to say, when the volume of the pumping chamber 12 is increased, the oil is sucked into the pumping chamber from the suction port 14. On the other hand, when the volume of the pumping chamber 12 is decreased, the oil is discharged from the pumping chamber 12 to the oil transmitting passage 15 through the discharge port 16. The oil sent into the oil transmitting passage 15 is fed to the portions required to be lubricated through the axial bore 17 and the branch apertures 18.

The above-mentioned oil feeder means, however, poses the following problems. When some variation occurs in the amount of oil in the case 1 whereby the surface level of the oil is lowered, or when the compressor itself is mounted in a state wherein it is inclined, it is possible that part of the suction entrance of the suction port 14 rises above, or protrudes from, the surface of the oil. In such a case, the gas in the case 1 is mixed into the pumping chamber 12 from the suction port 14 whereby the pumping action is hindered. Consequently, a sufficient amount of oil ceases to be fed into the axial bore 17 constituting the oil feeding port of the shaft 4.

Figure 3:
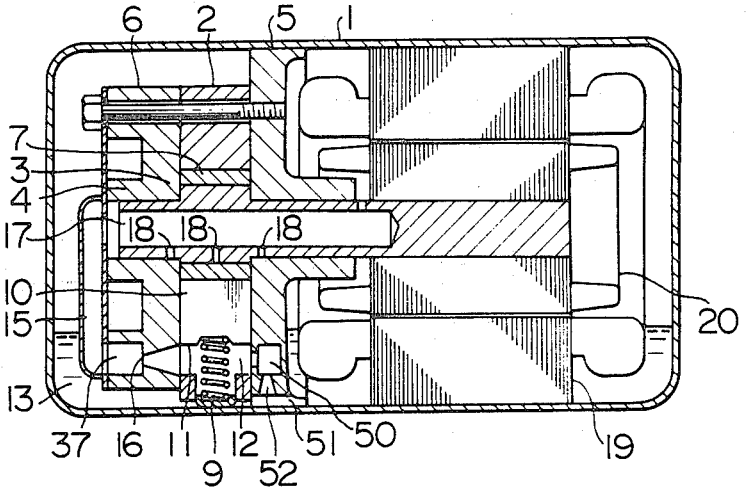
FIG. 3 is a sectional view of a rotary compressor according to the present invention.
Figure 4:
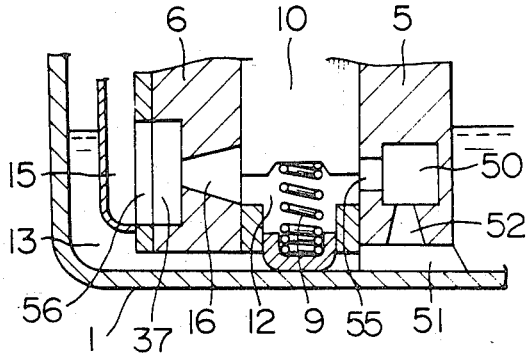
FIG. 4 is a sectional view of the part of the oil feeder means incorporated into the compressor of FIG. 3.

To avoid the above-noted problems with a construction such as illustrated in FIGS. 1 and 2, in accordance with the present invention, as shown in FIGS. 3 and 4, the suction port of the oil feeding mechanism includes a cylindrical space 50 provided in a side plate 5 and communicated with a pumping chamber 12 through the cylindrical passage 55. An oil feeding passage 51 is provided at the lower end of the side plate 5, with a downwardly facing suction port 52 being communicated with the space 50 and extending vertically downwardly open into the oil feeding passage 51.

With the above-mentioned construction, when the compressor is operated whereby a shaft 4 is rotated, a roller 7 is also rotated accordingly, a vane 10 is pushed by a spring 9 and, while its tip end is maintained in contact with the roller 7, makes its vertical reciprocating movement in a groove 8 of the cylinder as in the prior art compressor. In accordance with the reciprocating movement of the vane 10, the volume of the pumping chamber 12 is varied whereby the pumping action is performed. Namely, when the volume of the pumping chamber 12 is increased, oil 13 in a case 1 is drawn into the space 50 and then into the pumping chamber 12 after it is forced to pass through the downwardly facing suction port 52 from the oil feeding passage 51. At this time, the return flow of oil from an oil transmitting passage 15 into the pumping chamber 12 is small because the resistance of a discharge port 16 thereto is high. On the other hand, when the volume of the pumping chamber 12 is decreased, the oil is discharged from the discharge port 16 into the oil transmitting passage 15. At this time, the reverse flow of oil into the case is small because the resistance thereto at the downwardly facing suction port 52 is high.

As mentioned above, since the invention is arranged such that, in an oil feeder means adapted for use in a horizontal compressor and adapted to perform an oil pumping action, the oil 13 in the case 1 can be sucked from the oil feeding passage 51 provided at the lowest end of the side plate 5, i.e., from a portion nearer to the bottom of the case 1 than the portion from which the oil was sucked in the prior art case, it is less possible that the oil feeding passage 51 constituting the entrance of suction protrudes from the surface level of the oil, even when the amount of oil 13 within the case 1 is varied whereby the surface level is lowered.

The space 50 provided at the exit of the downwardly facing suction port 52 has further following effects. Since the space exists at the exit of the downwardly facing suction port 52, the vane 10, reciprocatingly moved in the vicinity of an end face 36 of the small-diameter portion constituting an exit of the suction port shown in FIG. 2, is less likely to be resistant to the flow of oil into the pumping chamber 12. Further, since the ratio between the cross sectional areas of the flow passage at its both ends can be chosen to have a great value, the resistance to the reverse flow of oil can be also made high whereby the effect, as of a check valve, of the downwardly facing suction port 52 can be made large, as a whole.

Figure 5:
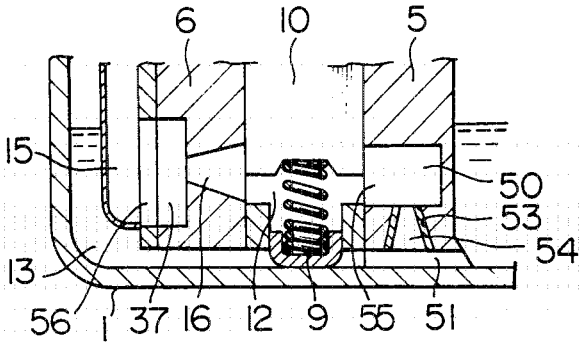
FIGS. 5 to 8 are respective sectional view of a portion of the oil feeder means according to other embodiments of the present invention.
Figure 6:
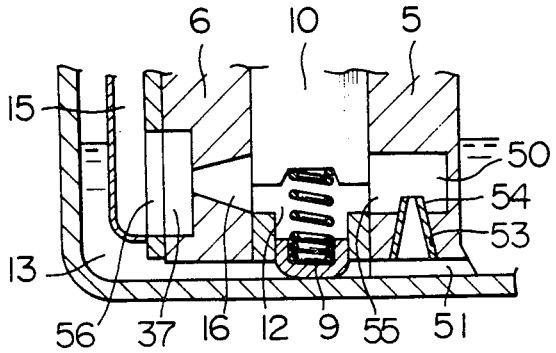

In the embodiment of FIG. 5, a separate suction piece is attached through an attachment hole to the side plate 5 in a manner that it faces or is directed vertically downwardly. The same action or function as in the above-mentioned embodiment is performed by attaching the suction piece 54 to the side plate 5 by way of the attachment hole 53. Since, according to this second embodiment, the oil in the case 1 is drawn from the separate suction piece 54, even when the side plate 5 is formed of a fragile material such as, for example, cast iron, it is possible to make the edge portion of the suction piece 54 sharp and uniform if the suction piece 54 is fabricated from an easily cuttable material, or by press forming. Accordingly, it is possible to increase the resistance to the reverse flow of oil at the region of the suction piece 54 and also to obtain a uniform performance as of the oil feeder means. In the third embodiment of FIG. 5, an exit portion of the suction piece 54 protrudes into the interior of the space 50. For this reason, the resistance to the reverse flow of oil at the region of the suction piece 54 increases. Namely, it is possible to increase the effect, as of a check valve, of the suction piece 54.

Figure 7:
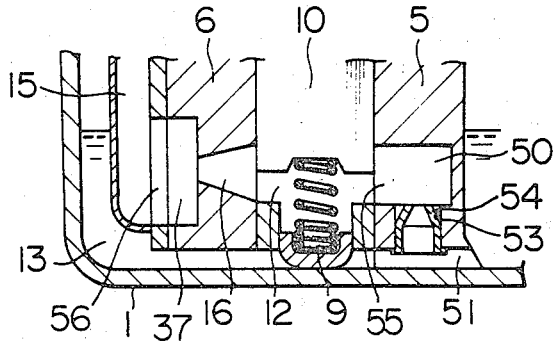

In the fourth embodiment of FIG. 7, the suction piece attachment hole 53 is vertically straight and a cylindrical force-fitting portion is provided at the entrance of suction of the suction piece 54, whereby the suction piece 54 is force-fitted into the attachment hole 53 and thus fixedly held in place. According to the embodiment of FIG. 7, the attachment hole 53 can be easily fabricated, the suction piece 54 can be firmly or securely fixed, and the attachment position at which the suction piece is attached can be also made uniform, whereby a uniform oil feeding performance is obtained.

Figure 8:
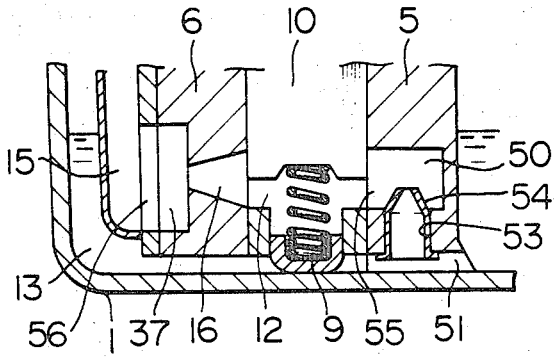

In the embodiment of FIG. 8, as in the embodiment of FIG. 7, the attachment hole 53 is vertically straight and a cylindrical force-fitting portion is provided at the entrance of suction of the suction piece 54, with an exit portion of the suction piece 54 protruding into the space 50. By such a protrusion, the resistance to the reverse flow of oil can be increased whereby the effect, as of a check valve, of the suction piece can be made great whereby a sufficient feeding amount of oil can be ensured.

According to the present invention, since the entrance of suction part of the oil feeding pump can be provided in the neighborhood of the bottom of the case, it is less possible that the entrance of suction port rises above, or protrudes from, the surface level of oil even when the amount of oil in the case is varied whereby the surface level of oil is lowered, thus ensuring the feeding of a stable or sufficient amount of oil into the portions concerned.

What is claimed is:

1. In a horizontal type rotary compressor constructed such that a compression element is provided within a case which includes a cylinder, a shaft having a crank thereon, a pair of side plates concurrently serving both as bearings of said shaft and as side walls of said cylinder, a roller fitted onto said crank, and a vane so arranged so as to slide in a groove of said cylinder and to have a tip end thereof contacted with said roller rotating in accordance with the rotation of said crank and an opposite end thereof pushed by a spring to make a reciprocating movement along said groove; a pumping chamber is defined by a rearface of said vane, said groove of said cylinder and said side plates; one of said side plates is formed therein with a suction port capable of sucking thereinto the oil within said case while the other of said side plates is formed therein with a discharge port for transmitting the oil in said pumping chamber to an oil feeding passage, an oil feeder means for use in said horizontal rotary pump compressor characterized in that a flow path from the suction inlet to the pumping chamber comprises a suction port tapered from the inlet thereof to the outlet thereof, said inlet being downwardly opened into an oil sump, a space provided at the side plate in which said suction port is opened, and a horizontal passage communicating said space to said pumping chamber, whereby said flow path has a resistance against the backflow of oil.

2. An oil feeder means for use in a horizontal type rotary compressor according to claim 1, wherein said suction port comprises a suction port tube having a tapered portion and a cylindrical portion successively connected thereto and being fitted into an attachment hole provided at said side plate.

3. An oil feeder means for use in a horizontal type rotary compressor according to claim 2, wherein said tapered portion of said suction port tube protrudes into said space to increase resistance against the backflow of oil.

4. An oil feeder means for use in a horizontal type rotary compressor according to claim 1, wherein said suction port includes a tapered suction port tube fitted into an attachment hole provided at said side plate.

5. An oil feeder means for use in a horizontal type rotary compressor according to claim 4, wherein said tapered suction port tube protrudes into said space to increase the resistance against backflow of oil.

* * * * *